US008191373B2

(12) United States Patent
Berry et al.

(10) Patent No.: US 8,191,373 B2
(45) Date of Patent: Jun. 5, 2012

(54) INTERLOCKING RETENTION STRIP

(75) Inventors: Jonathan Dwight Berry, Simpsonville, SC (US); Timur Rustemovich Repikov, Moscow (RU); Heath Michael Ostebee, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 765 days.

(21) Appl. No.: 12/366,913

(22) Filed: Feb. 6, 2009

(65) Prior Publication Data

US 2010/0199628 A1 Aug. 12, 2010

(51) Int. Cl.
*F02C 1/00* (2006.01)
*F02C 7/20* (2006.01)

(52) U.S. Cl. ..... 60/752; 60/796

(58) Field of Classification Search ..... 60/750–760, 60/770, 796
See application file for complete search history.

(56) References Cited

U.S. PATENT DOCUMENTS 6,966,188 B2 * 11/2005 Hirota et al. ..... 60/770
7,886,540 B2 * 2/2011 Webb ..... 60/752

* cited by examiner

*Primary Examiner* — Louis Casaregola
*Assistant Examiner* — Arun Goyal
(74) *Attorney, Agent, or Firm* — Cantor Colburn LLP

(57) ABSTRACT

An impingement shield assembly for a turbine includes a first impingement shield portion and a second impingement shield joined to the first impingement shield portion. The assembly also includes a first connection portion formed on the first impingement shield portion, a second connection portion formed on the first impingement shield portion and first and second wedge weld portions that mate with and hold the first and a second connection portions in a fixed relationship to one another.

5 Claims, 5 Drawing Sheets

INTERLOCKING RETENTION STRIP

BACKGROUND OF THE INVENTION

The subject matter disclosed herein relates to fasteners and, more particularly, to an interlocking retention strip for use in applications where weld bonding two pieces together are needed.

In the context of turbines used in the generation of electrical energy in a power plant, any time the turbine is not operational affects the profitability and effectiveness of the plant. According, reducing down time of turbines through component life extension is of great importance.

One cause of down time may come from having to make repairs to the turbine. For example, the turbine may include a turbine casing connected to a compressed air supply and including within the turbine casing a plurality of combustors and ducts surrounded by impingement sleeve for delivering hot gas to a turbine stage. Currently, the impingement sleeve is secured by welding two portions of the sleeve together utilizing a thin strip of plate (zipper strip) attached by fillet welds.

The zipper strip and areas surrounding it may be locations where cracks in the impingement sleeve begin. This may be due to the rigid joint between the two halves of the impingement sleeve at the location of the weld fluxuations in the sleeve shape during normal operation. Such cracks may lead to defects and, accordingly, repairs to the weld whenever they occur. Such repairs, however, are time consuming because, not only may the zipper strip need to be removed, the remnants of weld may have to be ground off of the impingement sleeve itself before a new zipper strip may be used. Further, the utilization of a zipper strip may not allow for the creation of a full penetration butt weld.

BRIEF DESCRIPTION OF THE INVENTION

One embodiment is directed to an impingement shield assembly for a turbine that includes a first impingement shield portion and a second impingement shield portion joined to the first impingement shield portion. The assembly also includes a first connection portion formed on the first impingement shield portion, the first connection portion including a first recess, and a second connection portion formed on the first impingement shield portion, the second connection portion including a second recess. The assembly also includes a first wedge strip portion shaped and configured to mate with the first recess and a second wedge strip portion shaped and configured to mate with the second recess. The first wedge strip portion is welded to the second wedge strip portion.

Another embodiment is directed to a method of welding two portions of a turbine impingement shield together. The method of this embodiment includes forming a first connection portion on a first portion of the impingement shield; forming a second connection portion on a second portion of the impingement shield; pressing the first portion and the second portion of the impingement shield towards one another; holding the first portion and the second portion of the impingement shield in a substantially fixed relationship to one another; and while holding: mating a first part of a wedge strip with the first connection portion; mating a second part of a wedge strip with the second connection portion; and welding the first part of the wedge strip to the second part of the wedge weld.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Embodiments of the present invention are directed to a wedge strip weld that may be especially beneficial in the context of securing the two halves of an impingement sleeve together. Of course, the wedge strip disclosed herein could be used in other settings. For example, the wedge strip of the present invention may be utilized in any situation where two pieces of metal are to be welded together.

Figure 1:
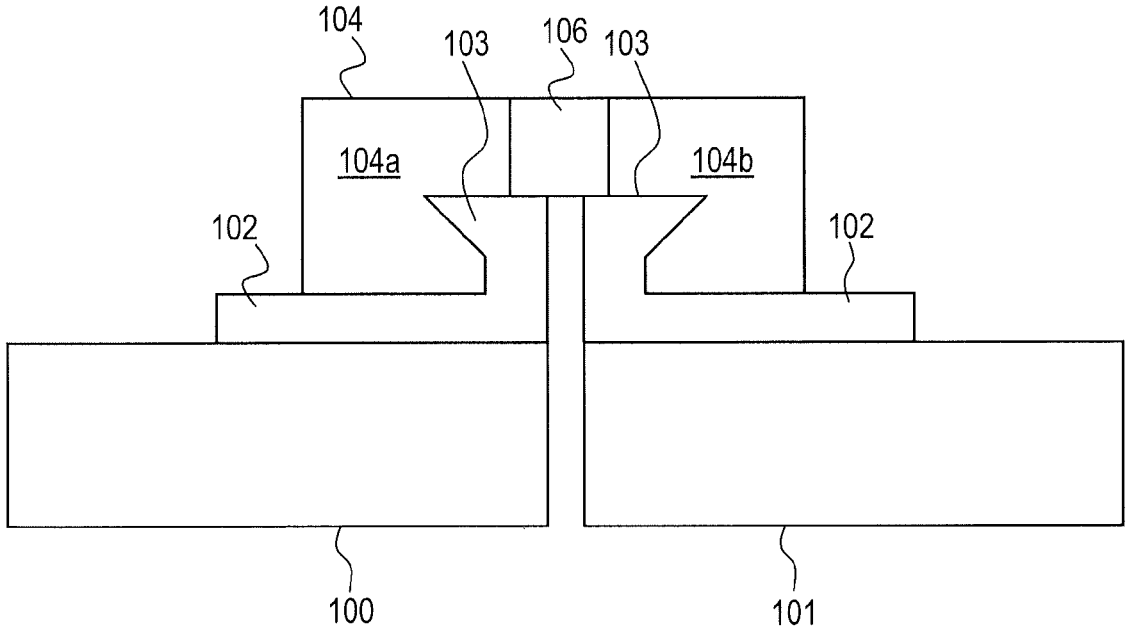
FIG. 1 cross-section of a welded wedge strip assembly according to one embodiment of the present invention.

FIG. 1 shows a weld assembly according to one embodiment of the present invention. The weld assembly includes a first portion 100 and a second portion 101 that are to be welded together. The first and second portions, 100 and 101, maybe any two pieces of material that may need to be welded together. In one embodiment, the first and second portions, 100 and 101, are the two halves on an impingement sleeve utilized in a turbine. The first and second portions 100 and 101 may be formed of metal or any other type substance that may withstand welding.

Both the first portion 100 and the second portion 101 include a weld base piece 102 attached thereto. In one embodiment, both the first portion 100 and the second portion 101 have a weld base piece 102 welded thereto. In such an embodiment, the weld between the first portion 100 and the weld base piece 102 may be a full penetration butt weld. Of course, the weld between the second portion 101 and the base weld piece 102 may also be a full penetration butt weld.

The weld base piece 102 may include an interlock portion 103 that extends outwardly from the, for example, first portion 100 when the weld base piece 102 is welded to or otherwise attached thereto. Further details of the interlock portion are discussed below.

The assembly shown in FIG. 1 may also include a wedge clamp 104 that holds the weld base pieces 102 attached to the first and second portions 100 and 101 in a substantially constant position relative to one another. Of course, in one embodiment, the weld base pieces 102 may have some relative movement between them.

In one embodiment, the wedge clamp 104 is formed by two pieces 104*a* and 104*b* that are attached to one another by clamp weld 106. The wedge clamp 104 may be constructed such that it includes a portion that interlocks with the interlock portion 103. This interlocking serves to hold the weld base pieces 102 substantially in the same position relative to one another. The two portions of the wedge clamp 104 may collectively be referred to herein as a "wedge strip."

In one embodiment, the wedge clamp 104 may not include a clamp weld 106, but, rather, may be a single wedge clamp having no weld joint that includes a channel to be positioned over the wedge base(s) 102 with the bottom edges of the channel pressed inward to form surface 302 and angle θ.

Figure 2:
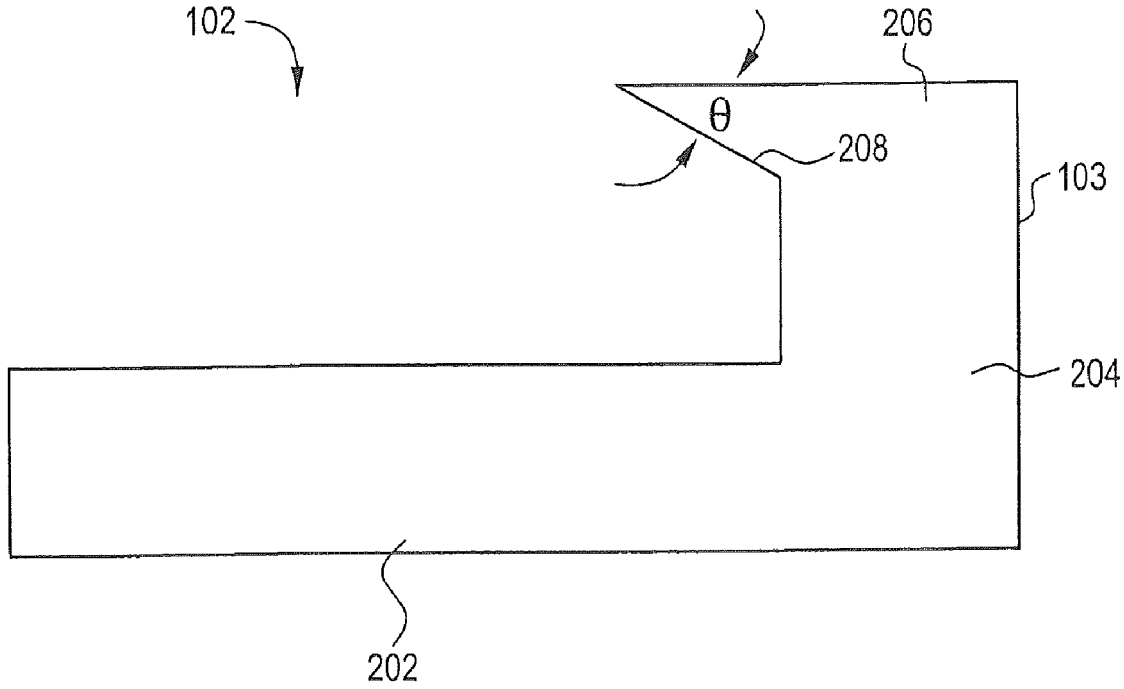
FIG. 2 is a side-view of a base weld piece according to one embodiment of the present invention.

FIG. 2 shows a more detailed view of a base weld piece 102 according to one embodiment of the present invention. The base weld piece 102 includes a base portion 202. In one embodiment, the base portion 202 may be welded to an element that is to be welded to another element. Extending up from the base portion 202 is an interlock portion 103. The interlock portion 103 shown in FIG. 2 includes an upward projection 204 that extends upwardly from the base portion 202. In one embodiment, and as shown if FIG. 2, the upward projection 204 extends from an edge of the base weld piece 103. Of course, the upward projection 204 need not extend from an edge and could be located, for example, in the middle of the base portion 202.

The interlock portion 103 also includes an upper portion 206 at a far end away from the base portion 202 of the upward projection 204. The upper portion 206 forms an angle θ with a downward edge 208. The downward edge 208 connects the upper portion 206 with the base portion 202. In one embodiment, the angle θ between upper portion 206 and the downward edge is less than 90 degrees. The downward edge 208 is configured to mate with an edge of the wedge clamp 104 (FIG. 1).

Figure 3:
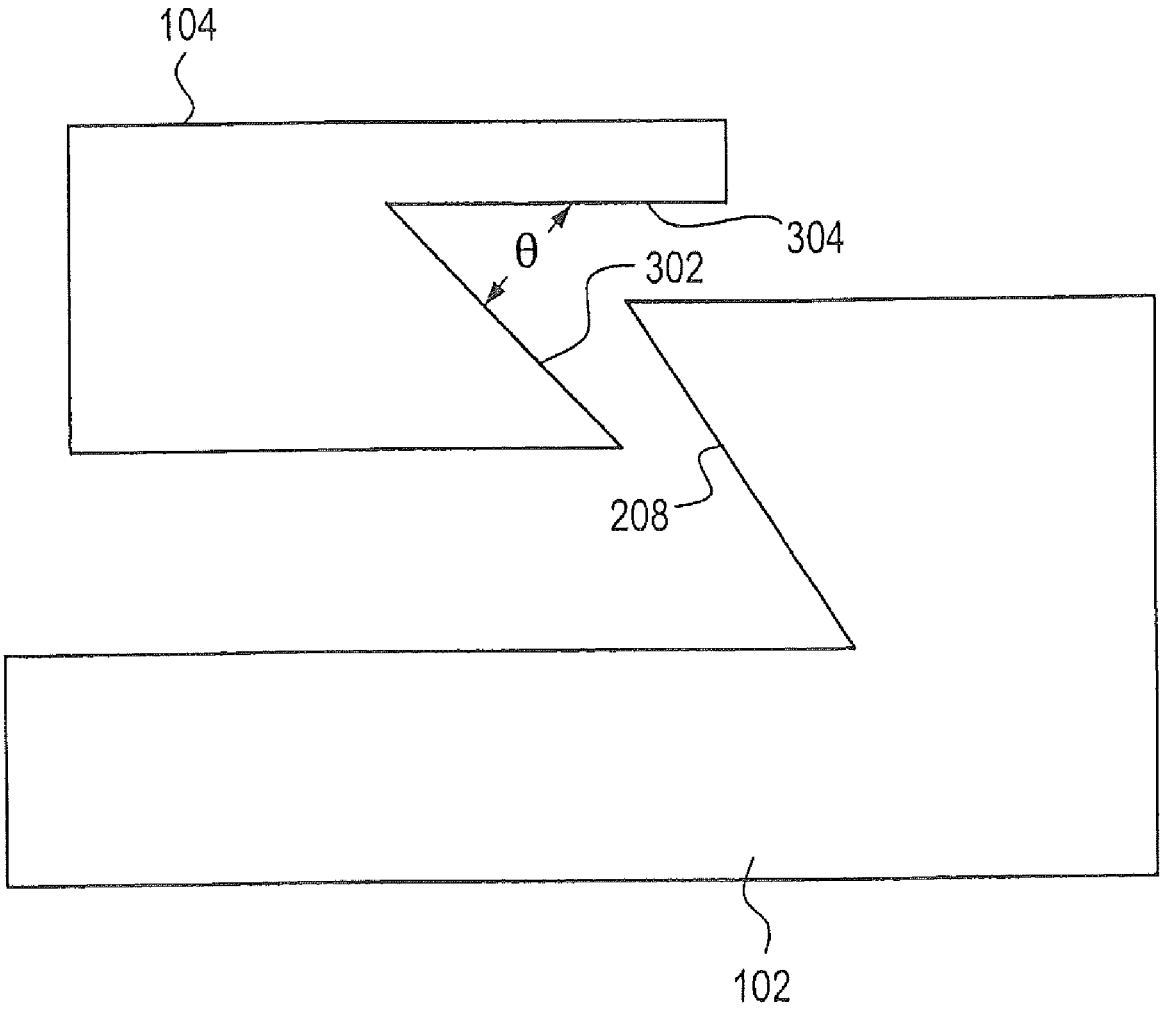
FIG. 3 is a detailed view of a wedge weld portion of an embodiment of the present invention.

FIG. 3 shows an example of a one half of a wedge clamp 104 loosely mated with a base weld piece 102. The wedge clamp 104 includes a mating edge 302 designed and configured to mate with the downward edge 208 of the base weld piece 102. The wedge clamp 104 includes a top edge 304 arranged such that angle θ exists between them. As shown in FIG. 3, the downward edge 302 and the top edge 304 are straight edges. Of course, these edges could be of any shape or configuration as long as they mate with the shape of the base weld piece 102.

Figure 4A:
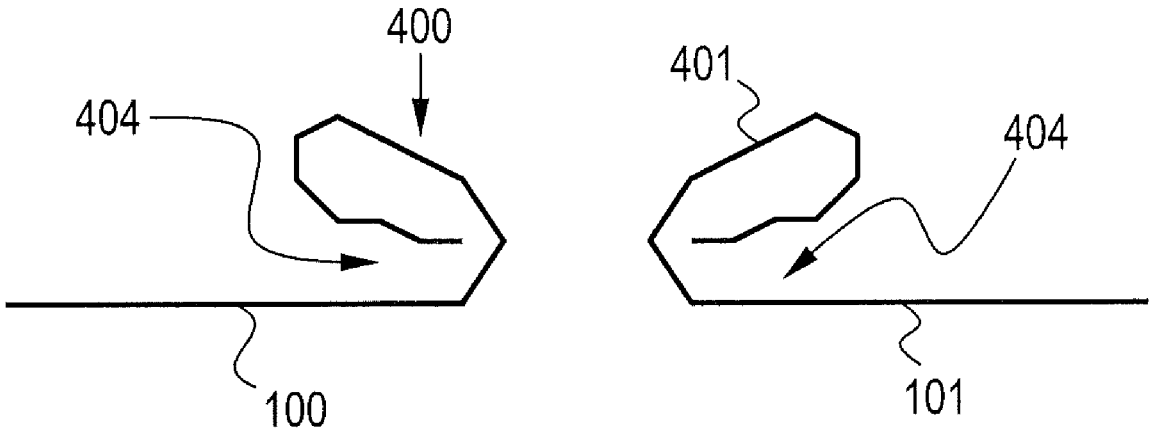
FIGS. 4*a* and 4*b* show another embodiment of the present invention.
Figure 4B:
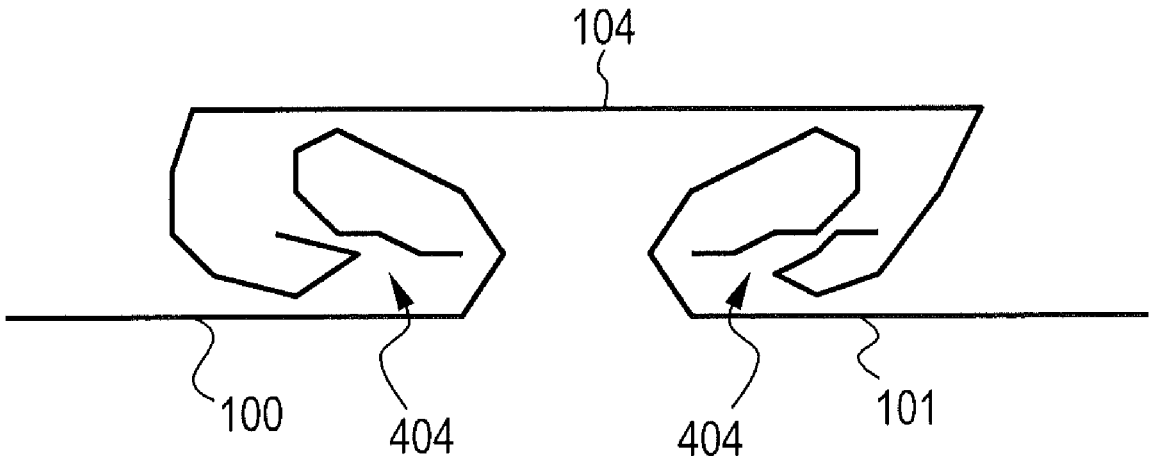

FIGS. 4*a* and 4*b* show an alternative embodiment of the present invention. In this embodiment, rather than including a separate base weld piece, the first portion 100 and the second portion 101 themselves are formed to include projections 400 and 401, respectively, that curve up and away from the first and second portions 100 and 101 in such a manner as to create a recess 404 for receiving a wedge clamp. This embodiment may require, in the case of an impingement sleeve, rolling an edge of the sleeve back.

FIG. 4*b* shows a wedge clamp 104 (after the two halves thereof have been welded together) mated with the first portion 100 and the second portion 101.

Figure 5:
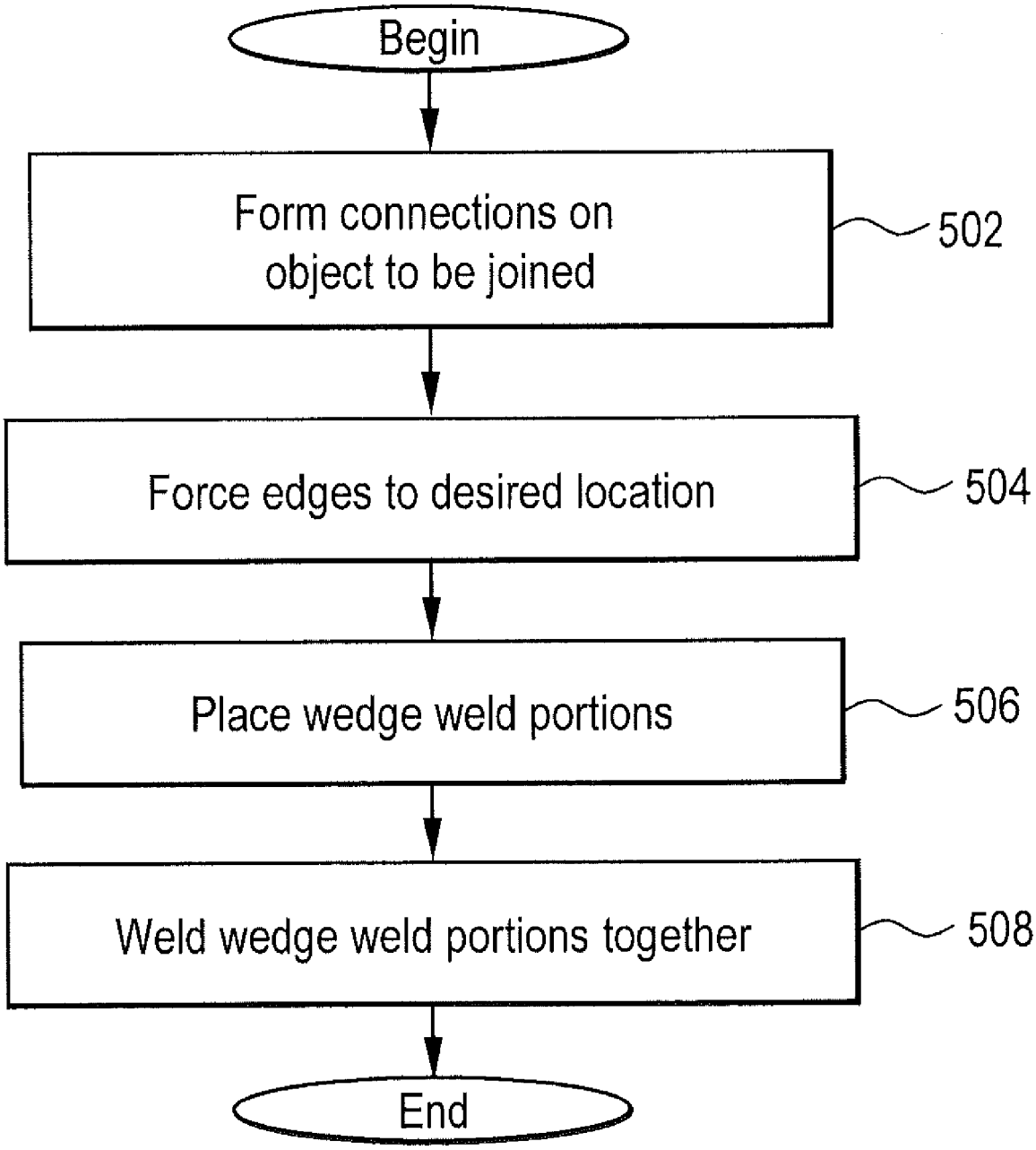
FIG. 5 shows a method of forming a weld according to one embodiment of the present invention.

FIG. 5 shows a method of forming a weld assembly according to one embodiment of the present invention. At a block 502 connections are formed on the pieces to be joined. As discussed above, this may include either welding a base weld piece to the pieces to be joined or forming the connection pieces from the pieces to joined themselves. At a block 504 the edges of the pieces to be joined are forced or pressed together with hand clamps or weld fixtures. At a block 506 the two portions that make up the wedge clamp 504 (FIG. 1) are placed such that they mate with the connection pieces. At a block 508 the clamp weld pieces are welded together. In one embodiment, this may allow for a full penetration weld and may hold the pieces to be joined in a substantially fixed relationship relative to one another.

In the prior art, in the event that a zipper strip may have to be removed multiple steps had to be employed. These steps may include first cutting the zipper strip along its length into halves with a cutoff wheel. Then, the welds on each side of the zipper strip may have to be cut. After cutting the welds, the zipper strip may have had to have been chiseled or ground off of the pieces welded together. In some instances, the remnants of the weld may have had to have been ground off from the pieces that were welded together. Finally, some blending or smoothing the blemishes off the pieces so that a new a zipper weld may be placed may also have been required. According the present invention, all that needs to be done is to cut the wedge clamp and remove it. A new wedge claim may then be affixed as described above and, thereby, greatly reducing downtime and repair time due to any repairs that require removal of the wedge clamp.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An impingement shield assembly for a turbine, the assembly comprising:

a first impingement sleeve portion;

a second impingement sleeve portion joined to the first impingement sleeve portion;

a first connection portion formed on the first impingement sleeve portion, the first connection portion including a first base portion, a first upper portion and a first downward edge extending between the first upper portion and the first base portion, the first upper portion and the first downward edge forming a first angle between them that is less than 90 degrees;

a second connection portion formed on the second impingement sleeve portion, the second connection portion including a second base portion, a second upper portion and a second downward edge extending between the second upper portion and the second base portion, the second upper portion and the second downward edge forming a second angle between that is less than 90 degrees;

a first wedge strip portion shaped and configured to mate with the first connection portion and including a first mating edge and a first top edge disposed at the first angle relative to one another and arranged such that the first mating edge is in contact with the first downward edge; and a second wedge strip portion shaped and configured to mate with the second connection portion connection portion and including a second mating edge and a second top edge disposed at the second angle relative to one another and arranged such that the first mating edge is in contact with the first downward edge;

wherein the first wedge strip portion is welded to the second wedge strip portion.

2. The assembly of claim 1, wherein the first connection portion is welded to the first impingement sleeve and the second connection portion is welded to the second impingement sleeve portion.

3. The assembly of claim 2, wherein the first connection portion includes a base portion coupled to the first impingement sleeve portion and includes an interlock portion that extends outwardly from the base portion.

4. The assembly of claim 3, wherein the interlock portion includes an upper portion and a downward edge having a fixed relationship between them and wherein the upper portion and the downward edge form the first recess.

5. The assembly of claim 1, wherein the weld between the first wedge strip portion and the second wedge strip portion is a full penetration butt weld.

* * * * *